US006202921B1

(12) United States Patent
Chen

(10) Patent No.: US 6,202,921 B1
(45) Date of Patent: Mar. 20, 2001

(54) CUP WITH AN IMPROVED HOLDER

(75) Inventor: Chin Chen Chen, No. 7 Alley 5, Lan 3, Ryh Shin Rd., Dong Shan, Yi Lan County (TW)

(73) Assignees: Chin Chen Chen, Yi Lan; Tsu Kuo Huang, Keelung, both of (TW)

( * ) Notice: Subject to any disclaimer, the term of this patent is extended or adjusted under 35 U.S.C. 154(b) by 0 days.

(21) Appl. No.: 09/449,562

(22) Filed: Nov. 29, 1999

(51) Int. Cl.[7] ..... B65D 3/28
(52) U.S. Cl. ..... 229/402; 220/741; 220/771
(58) Field of Search ..... 220/741, 752, 220/771; 229/402

(56) References Cited

U.S. PATENT DOCUMENTS 2,075,049 * 3/1937 Niemi ..... 229/402
2,251,017 * 7/1941 Jopson ..... 229/402
2,287,644 * 6/1942 Schacht ..... 229/402
2,652,971 * 9/1953 McFarland et al. ..... 229/402
2,868,434 * 1/1959 Jones ..... 229/402
6,116,503 * 9/2000 Varano ..... 229/402

* cited by examiner

*Primary Examiner*—Joseph M. Moy
(74) *Attorney, Agent, or Firm*—Bacon & Thomas, PLLC

(57) ABSTRACT

An improved cup device including a cup unit having an improved holder. The cup device includes a one-piece holder structure with two parallel sides, a holding part, a supporting part having two parallel sides, and a fitting part positioned between the two parallel sides of the supporting part. The supporting part contacts the side of the cup unit. The holding part is located at the two parallel sides of the one-piece holder structure and positioned above the supporting part in a direction away from the side of the cup unit. An upper portion of the supporting part includes an extruded rib. The fitting part is positioned at a tail end of the one-piece holder structure and below the holding part. The fitting part rests against the side of the cup unit. The extruded rib is upwardly pushable to enable a front part of the supporting part to bend and form a tied pressing part that can be pressed and locked to the upper edge of the cup unit. The supporting part is deformable to permit the holding part to bend and form a storage space to provide for a user's fingers to pass therethrough.

3 Claims, 6 Drawing Sheets

CUP WITH AN IMPROVED HOLDER

BACKGROUND OF THE INVENTION

1. Field of the Invention

The invention relates to disposable cups, more particularly, a disposable cup with an improved holder.

2. Description of the Related Art

Disposable cups have gained wide popularity because of they are convenient to use. However, such disposable cup devices contain certain defects. For instance, prior art cup devices are made of paper or plastic and therefore if such disposable cups are used to receive very hot drinks, since the thermal insulation properties are not adequate, the user of the cup may have extreme difficulty in holding such a cup filled with a hot liquid, resulting in injury to the user. One solution is to provide a holder for the disposable cup, which is typically made of a paper or plastic material. Such a fastening or holding device attached or clipped typically to the edge of the disposable cup enables a user to avoid direct thermal contact with the cup device filled with a hot liquid. Such a design can solve the problem of direct thermal contact with the contents of the cup, yet it is still inconvenient to use because the disposable cup and the attached holder are two separate elements. Providing for a cup and a separate holder that is later assembled together will add to the production cost, as well as the labor cost in assembling the cup with the separate holder.

SUMMARY OF THE INVENTION

The primary objective of the present invention is to solve the problems associated with prior art disposable cup devices. The present invention utilizes a single unit incorporating a holder that will be formed into a disposable cup, thereby simplifying and reducing the costs of production of the device.

Another objective of the present invention is to provide a disposable cup which is convenient to use, with good holding characteristics and provides adequate thermal protection from the hot contents of the cup for the user.

BRIEF DESCRIPTION OF THE DRAWINGS

FIG. 2-1 is a front view of the present invention with the holder in a collapsed position;

FIG. 2-2 is a right-side view of the present invention;

FIG. 2-3 is a view of the present invention prior to assembly;

FIG. 3-1 is a schematic view of the present invention in use;

FIG. 3-2 is a front view of the present invention with the holder in an extended position.

DETAILED DESCRIPTION OF THE PREFERRED EMBODIMENT

Figure 1:
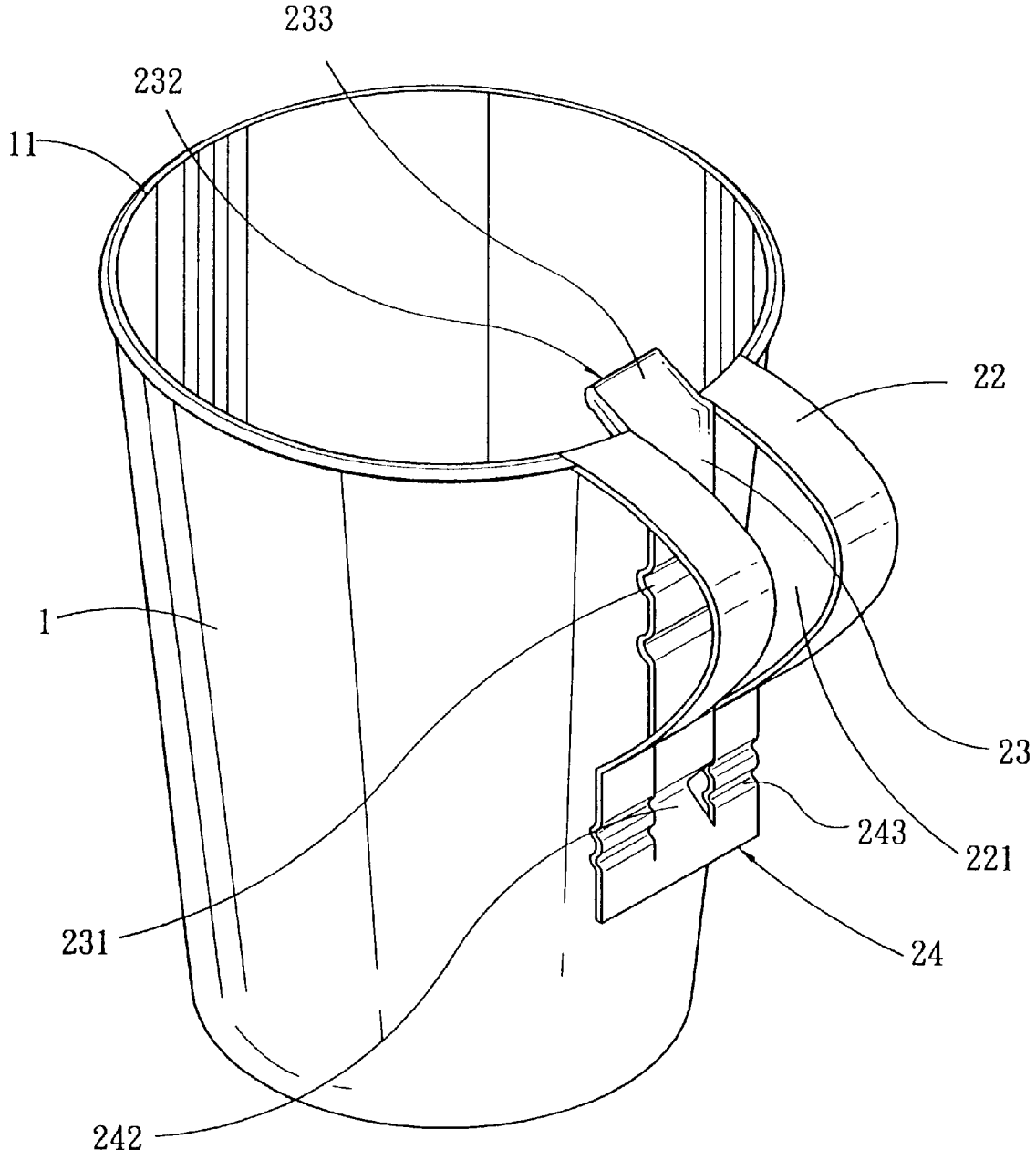
FIG. 1 is a schematic view of the present invention.
Figures 1, 2:
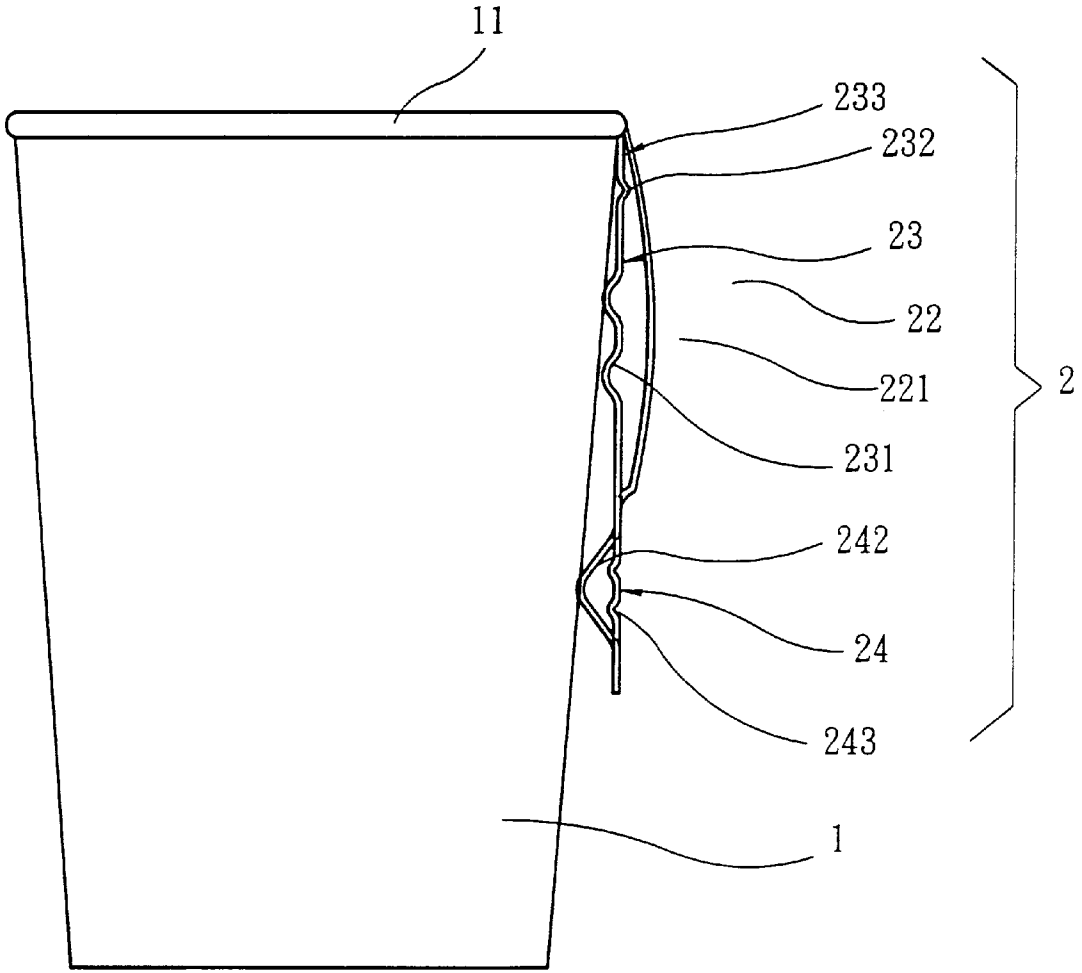
Figure 2:
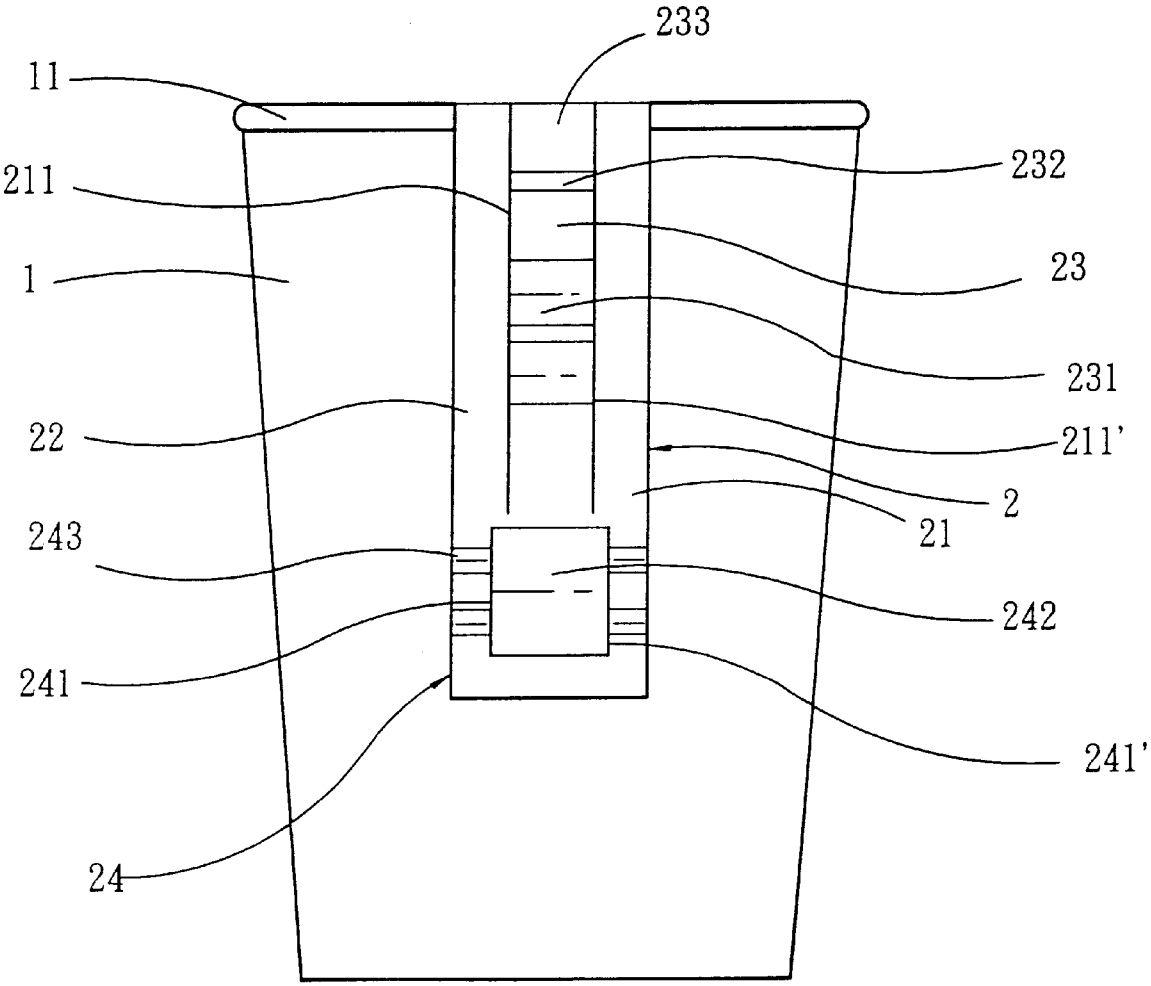
Figures 2, 3:
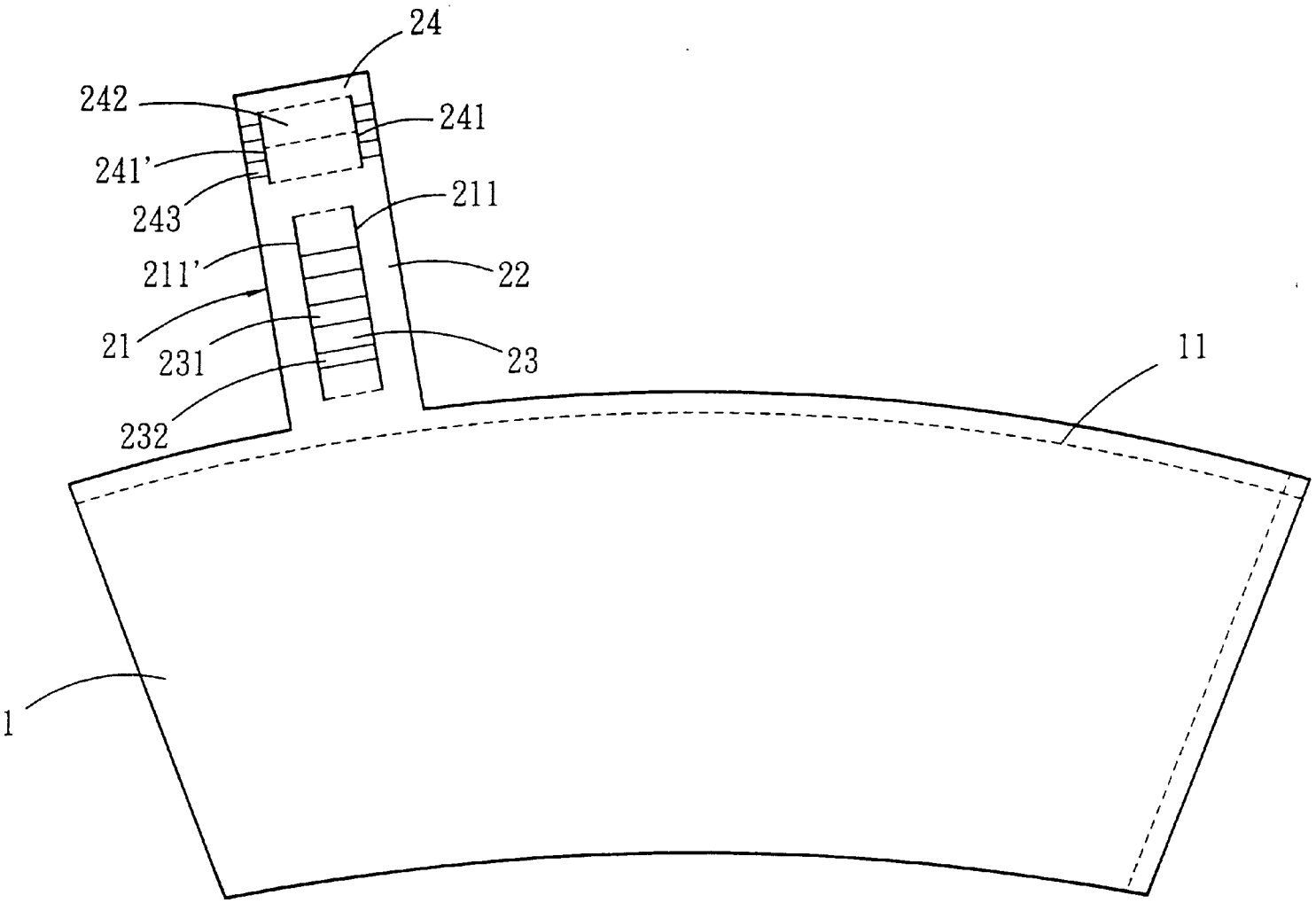
Figures 1, 3:
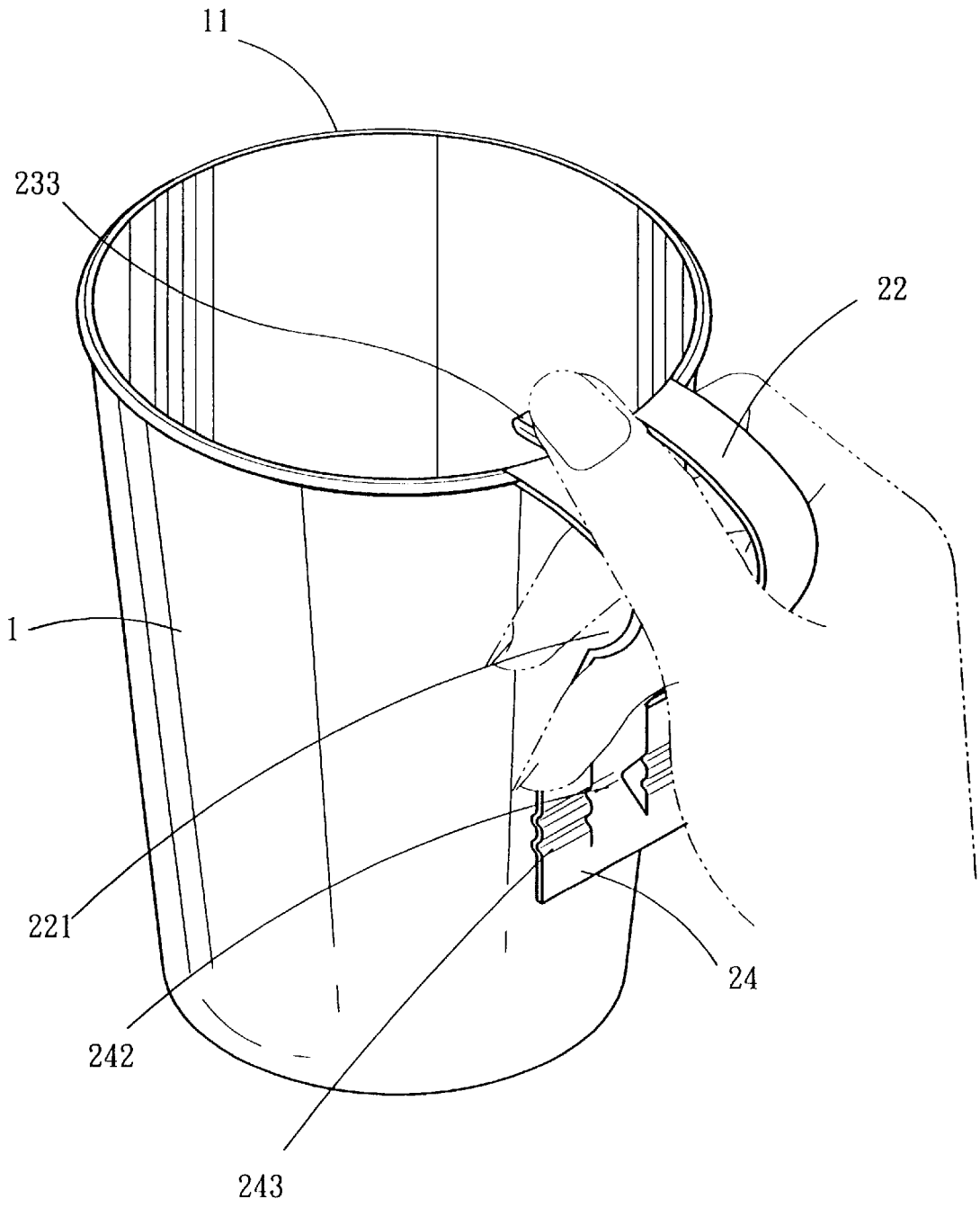
Figures 2, 3:
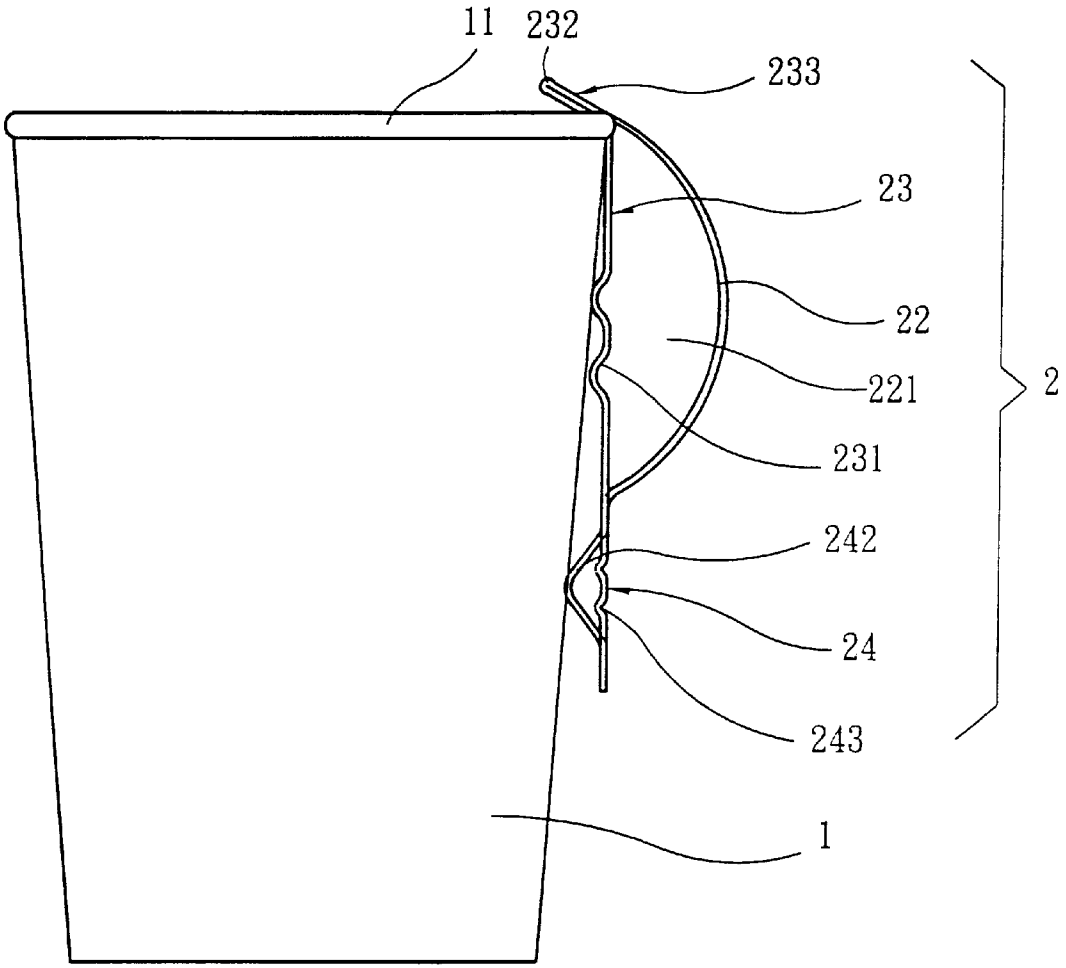

As shown in FIGS. 1 and 2-1 to 2-3, the present invention comprises a cup unit 1, having an upper edge 11, and a holder structure 2. The holder structure 2 comprises a piece unit 21 which after being properly cut, can define a holding part 22, a supporting part 23 and a fitting part 24. The holding part 22 is formed by making two parallel cutting lines 211, 211' in the piece unit 21, as shown in FIG. 2-3. The holding part 22 is defined at both sides of the piece unit 21. In addition, the scope of the area that is formed inside and between the two cutting lines 211, 211', and the supporting part 23 can also be defined. In addition, at a proper location on the supporting part 23, there is an even number of thermal protection slide prevention ribs 231 having concave dents as shown in FIGS. 1, 2-1, 3-1 and 3-2. Further, the upper part of the supporting part 23 includes an extruded rib 232.

The fitting part 24 is positioned at the tail end of the piece unit 21. On the fitting part 24, there are two additional parallel cutting lines 241, 241', as shown in FIG. 2-3. The area between the cutting lines 241, 241' is defined by a holding area 242. Both sides of the fitting part 24 include several even number of thermal protection slide prevention ribs 243 having concave dents, as clearly shown in FIGS. 1, 2-1 and 2-3.

As the extruded rib 232 is pushed upwards by an external force, the front part of the supporting part 23 fold to form a tied pressing part 233 that can be pressed and positioned on the edge 11 of the cup unit 1. In addition, since the length of the support part 23 would be shortened, this allows for the holding part 22 to bend and form a storing space 221, with the supporting part 23 and the holding part 22 to permit the fingers of the user to go into the storing space 221, as shown in FIGS. 2-1 and 3-2.

Referring to FIGS. 3-1 and 3-2, prior to the use of the present invention, it is necessary to push and squeeze the extruded rib 232 upwards, making the front end of its supporting part 23 to form a tied pressing part 233, thereby allowing the thumb of the user to be able to press on the edge 11 of the upper part of the cup unit 1, as the index finger of the user passes through the storage area 221 of the holding part 22. The formation of the holder of the cup defined by the slide prevention rib 231 of the supporting part 23 and the holding part 22 provides for adequate thermal protection for the user. The holding part 22 substantially supports the weight of the liquid in the cup unit, via lever laws, forces the fitting part 24 at the lower part of the holding part 22 to fit against the side edge of the cup unit 1, and permit the user's middle finger to fit therethrough. The holding area 242 formed below the fitting part 24, as shown in FIG. 3-2, can obtain the objective of heat segregation between the user and the cup unit 1. The overall structure of the present invention contributes towards the stability of the liquid contained in the cup unit 1 and provides for a distribution of the holding force to maintain an overall balance for the cup unit after liquid has been poured into the cup unit 1.

By tying and pressing onto the upper edge 11 of the cup unit 1 via the tied pressing part 233, the overall device is stable when held by a user. In particular, when the cup unit 1 is tilted to permit the pulling of the liquid contained therein to be served to the user, this stability can still be maintained without deviation.

The present invention is by no means restricted to the above-described preferred embodiment, but covers all variations that might be implemented by using equivalent functional elements or devices that would be apparent to a person skilled in the art, or modifications that fall within the spirit and scope of the appended claims.

What is claimed is:

1. An improved cup device comprising:

a cup unit having an upper edge and a side;

a one-piece holder structure comprising two parallel sides, a holding part, a supporting part having two parallel sides, a fitting part positioned between the two parallel sides of the supporting part, the supporting part contacts the side of the cup unit;

the holding part is located at the two parallel sides of the one-piece holder structure and positioned above the supporting part in a direction away from the side of the cup unit, an upper portion of the supporting part comprises an extruded rib;

the fitting part is positioned at a tail end of the one-piece holder structure and is positioned below the holding part, the fitting part rests against the side of the cup unit;

the extruded rib is upwardly pushable to enable a front part of the supporting part to bend and form a tied pressing part that can be pressed and locked to the upper edge of the cup unit; and the supporting part is deformable to permit the holding part to bend and form a storage space to provide for a user's fingers to pass therethrough.

2. The improved cup device as claimed in claim 1, wherein the holder structure is integrally formed on the upper edge of the cup unit.

3. The improved cup device as claimed in claim 1, wherein an even number of thermally protective slide prevention ribs are provided at the fitting part.

* * * * *